US005198327A

United States Patent [19]

Yamada et al.

[11] Patent Number: 5,198,327

[45] Date of Patent: Mar. 30, 1993

[54] METHOD OF FORMATION OF PHOTOGRAPHIC IMAGES

[75] Inventors: Minoru Yamada; Naoki Arai; Kazuo Kagawa, all of Kanagawa, Japan

[73] Assignee: Fuji Photo Film Co., Ltd., Kanagawa, Japan

[21] Appl. No.: 812,857

[22] Filed: Dec. 23, 1991

Related U.S. Application Data

[63] Continuation of Ser. No. 488,365, Feb. 16, 1990, abandoned, which is a continuation of Ser. No. 181,991, Apr. 15, 1988, abandoned.

[30] Foreign Application Priority Data

Apr. 16, 1987 [JP] Japan ..... 62-92070

[51] Int. Cl.[5] ..... G03C 5/16

[52] U.S. Cl. ..... 430/363; 430/419; 430/542; 430/564; 430/567; 430/963; 430/966

[58] Field of Search ..... 430/363, 419, 963, 966, 430/967, 542, 564, 567

[56] References Cited

U.S. PATENT DOCUMENTS

| | | | |
|---|---|---|---|
| 4,030,924 | 6/1977 | Hofman | 430/963 |
| 4,288,535 | 9/1981 | Kanisawa et al. | 430/963 |
| 4,520,098 | 5/1985 | Dickerson | 430/966 |
| 4,564,588 | 1/1986 | Sakamoto et al. | 430/967 |
| 4,587,729 | 4/1986 | Sugimoto et al. | 430/966 |
| 4,748,106 | 5/1988 | Hayashi | 430/434 |
| 4,897,340 | 1/1990 | Ohtani et al. | 430/966 |

*Primary Examiner*—Hoa Van Le

*Attorney, Agent, or Firm*—Sughrue, Mion, Zinn, Macpeak & Seas

[57] ABSTRACT

For formation of a photographic image by development of a silver halide photographic material with an automatic developing machine, a certain period of time or not longer than 15 seconds is set as the time of the development step and a silver halide photographic material is used which, when developed for a period of one-half of said certain period of time after such an exposure that the exposed silver halide photographic material, when developed for said certain period of time, would give a value of $(D_{max}-fog)\times\frac{1}{2}$, gives a value of (D-fog) having 70% or more of the value of $(D_{max}-fog)\times\frac{1}{2}$. The silver halide photographic material comprises at least one of a combination of (1), (2) and (3) or (2) and (4): where: (1) represents a silver halide emulsion containing a water-soluble iridium salt; (2) represents a silver halide emulsion layer with a silver amount from 1 to 3.5 grams/$m^2$ coated on one surface of said emulsion layer; (3) represents silver halide grains wherein the mean grain size is 1.0 $\mu$ or less; and (4) represents tabular silver halide grains having an aspect ratio of 4 or more. By the rapid development procedure, a sharp image with no development unevenness (drag streaks) can be obtained and the automatic developing machine to be used may be made small-sized and compact.

4 Claims, 1 Drawing Sheet

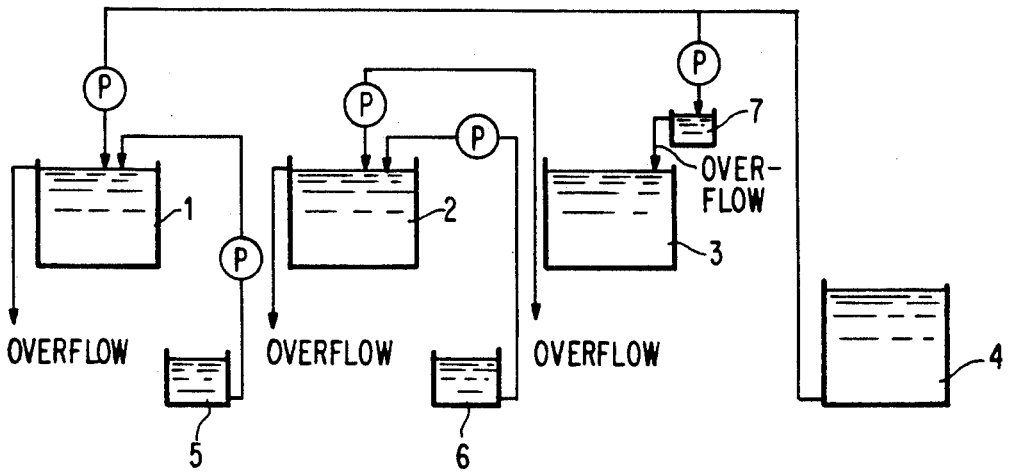
P
P
P
P
P
7
OVER-
FLOW
1
2
3
4
5
6
OVERFLOW
OVERFLOW
OVERFLOW

METHOD OF FORMATION OF PHOTOGRAPHIC IMAGES

This is a continuation of application Ser. No. 07/488,365, filed Feb. 16, 1990, now abandoned, which is a continuation of application Ser. No. 07/181,991, filed on Apr. 15, 1988, now abandoned.

FIELD OF THE INVENTION

The present invention relates to a method of forming an image of a silver halide photographic material, and in particular, to that of forming a sharp image with no image unevenness by rapid development of a silver halide photographic material with an automatic developing machine.

BACKGROUND OF THE INVENTION

In the general, silver halide photographic materials may form images by a development process comprising the steps of development, fixation and rinsing-in-water (stabilization).

Hitherto, the development step in the procedure comprising development, fixation and rinsing-in-water could be performed for a shortened period of time of, for example, from 15 seconds to 18 seconds only for development for small image area units such as microphotographs. Also, a rapid processing, for example, for 20 seconds was possible only for printing light-sensitive materials comprising silver chlorobromide.

In these days, rapidity is being required in every technical field with progress and development of electronic technology, not excepting the photographic field. In particular, in a roller conveyor type automatic developing machine to be used for processing of sheet-like light-sensitive materials such as, for example, graphic art light-sensitive materials, X-ray light-sensitive materials, scanner light-sensitive materials, CRT image recording light-sensitive materials, etc., the tank capacity necessary for development of a unit of the light-sensitive material for a unit period of time may be smaller with the promotion of the rapid development, or that is, the automatic developing machine to be used for the development may advantageously be small, and therefore, the rapid development is desired.

On the other hand, in the development of hard contrast photographic materials such as graphic art light-sensitive materials, a so-called "Bromide dragging" or "drag streaks" has heretofore been known, which means a phenomenon wherein the development of the part which is adjacent to the strongly developed part is retarded so that the density thus actually attained in the former part would be lower than the density which is to be naturally obtained. This is one of the significant problems in the photographic image formation method which is intended to obtain accurate images and accurate informations, since this is against the intent of the method. The said development retardation (inhibition) is considered to be caused by $H+$ and $Br-$ generated in the developed part, and it is believed that the former would result in development deactivation because of a local pH drop and the latter would directly cause development inhibition. The problem is more severe in the rapid development process where the time development step is shortened. This is because the amounts of $H+$ and $Br-$ generated in a unit time are large in the rapid development procedure. This problem has heretofore been despaired of with no idea for overcoming the same, since it has been considered that the problem is unavoidable so far as silver halide photographic materials to be developed with a developer containing a hydroquinone series developing agent are concerned.

Under the circumstances, the present inventors investigated a technique of finishing the development of silver halide photographic materials with an automatic developing machine within 15 seconds or less, which has heretofore been unknown in this technical field, so as to increase the rapidity of the development. However, during the trial of the rapid development with an automatic developing machine within 15 seconds or less, the inventors met with an unknown phenomenon of development unevenness. Such development unevenness is thought to be caused by the fact that, in the rapid development step, the speed of conveying the photographic material being processed in the automatic development machine is rapid in addition to the increased amounts of $H+$ and $Br-$ as mentioned above so that the development-inhibiting effect would be strengthened in the latter step of the development of the photographic material. Thus, good photographic images would not be able to be obtained with the present-day technique without overcoming the problem of unevenness (bromide dragging or drag streaks)

SUMMARY OF THE INVENTION

Accordingly one object of the present invention is to provide a method of effectively overcoming the development unevenness which occurs in the rapid development of a silver halide photographic material with an automatic developing machine in which the development step is finished within 15 seconds or less.

Another object of the present invention is to provide a method of forming a photographic image by rapid processing of a silver halide photographic material.

Still another object of the present invention is to provide a method of rapidly forming a photographic image in a silver halide photographic material with a small and compact automatic developing machine.

It has been found that these objects can be attained by the provision of a novel method of forming an image by development of a silver halide photographic material with an automatic developing machine, in which a certain period of time of not longer than 15 seconds is set as the time of the development step and the silver halide photographic material is used which, when developed for a period of one-half of said certain period of time after such an exposure that the exposed silver halide photographic material, when developed for said certain period of time, would give a value of $(Dmax-fog)\times\frac{1}{2}$, gives a value of (D-fog) having 70% or more of the value of $(Dmax-fog)\times\frac{1}{2}$. The certain period of time of not longer than 15 seconds is hereinafter referred to as a standard development time.

"Dmax" means the maximum density to be obtained by development for the standard development time with a sufficient exposure having been imparted to the photographic light-sensitive material, in accordance with the present invention; and "fog" means the fog density of the thus developed material. "D" means the density to be obtained by developing an exposed photographic light-sensitive material for a period of one-half of the standard development time, in accordance with the present invention.

BRIEF EXPLANATION OF DRAWING

The Figure shows one embodiment of the automatic developing apparatus system for performing the method of the present invention, where (1) is a development tank, (2) is a fixation tank, (3) is a rinsing tank, (4) is a water stock tank, (5) is a concentrated developer stock tank, (6) is a concentrated fixing solution stock tank, (7) is a squeeze roller-washing tank, and (P) is a pump.

DETAILED DESCRIPTION OF THE INVENTION

The photographic light-sensitive material for use in the present invention has a rapid developability such that 70% or more of the native character can be developed within one half of the standard development time of the development step when the material was exposed to give a value of $(D_{max}-fog)\times\frac{1}{2}$.

The "time of the development step" (development time) in the automatic developing machine (hereinafter referred to as "AD machine") means the period from the point when the top of the photographic light-sensitive material being processed begins to be dipped in a developer to the point when the material begins to be dipped in the next stopping bath or fixation bath. Since it is in fact difficult to develop the material for a period of one-half of the determined development time in an AD machine, the characteristic of the development procedure of the material will be defined on the basis of the method described below in place of the method of developing the material for one-half of the period of time.

(1) The corresponding processing solution is put in the processing tank.

(2) The processing temperature is adjusted to the determined temperature.

(3) The corresponding photographic light-sensitive material is exposed under the corresponding exposure condition and developed with the processing solution while the material is moved up and down in the processing solution once a second.

In the development of a conventional photographic light-sensitive material/processing system, in general, the development proceeds almost in proportion to the development time. Above all, the development procedure of the tabular silver halides with a high aspect ratio described in *Research Disclosure* 22534 (Jan. 1983) as well as silver halides having a larger chloride content is known to be relatively rapid. In addition, it is also known that the development speed of an aminophenol/hydroquinone series developer is higher than that of a pyrazolone/hydroquinone series developer. However, the results of these development procedures were attained by longer development than in the case of the method of the present invention. The attainment of the rapid development procedure by the present invention in which 70% or more of the native character can be developed in a short period of time, or in one-half of the rapid processing time of 15 seconds or less, could not be anticipated or expected by anyone skilled in the art from any conventional technical concept. Although the mechanism of overcoming the drag streaks is not completely understood, a surprising effect of eliminating the drag streaks could be attained only by the present invention in which the photographic material is processed by the rapid development procedure as above.

In the practice of the present invention, it is indispensable that 70% or more of the native character is developed for a period of one-half of the standard development time, but 75% or more, especially 80% or more, is preferably developed for this period.

The photographic light-sensitive material which can rapidly be developed in accordance with the rapid development procedure of the present invention can be prepared, for example, as follows.

(1) A silver halide containing a small amount of iodine or containing no iodine is used. Specifically, silver chloride, silver bromide, silver chlorobromide, silver iodochloride, silver chloroiodobromide or the like which contains silver iodide in an amount of none up to 5 mol % is used.

(2) A water-soluble iridium salt is incorporated into the silver halide emulsion.

(3) In the silver halide emulsion layer, the amount of silver coated is made small. For example, the silver coated on one surface is from 1 to 3.5 $g/m^2$, preferably from 1 to 3 $g/m^2$.

(4) The mean grain size of the silver halide grains in the emulsion is made small. For example, the size is 1.0 $\mu$ or less, preferably 0.7 $\mu$ or less.

(5) As the silver halide grains in the emulsion, tabular grains, for example, having an aspect ratio of 4 or more, preferably 5 or more, are used.

(6) The swelling percentage of the silver halide photographic material is made to be 200% or less, preferably 30% to 200%, more preferably 50% to 150%.

In the present invention, any one of the above-mentioned methods (1) to (6), preferably a combination of any two or more of them, is employed, and accordingly, the intended photographic light-sensitive material which, when developed for a period of one-half of the standard development time after such an exposure that the exposed photographic material would give a value of $(D_{max}-fog)\times\frac{1}{2}$, gives a value of (D-fog) having 70% or more of the value of $(D_{max}-fog)\times\frac{1}{2}$, can be obtained. Among the above-mentioned methods (1) to (6), the combination of (2), (3) and (4), the combination of (3) and (4) or the combination of (3) and (5) is preferred. Most preferably, the said combination is further combined with any one or more of (1), (2) and (6).

Hard contrast photographic light-sensitive materials, for example, those having a $\gamma$ value of 1.5 or more, especially from 1.6 to 5, often have the above-mentioned drag streaks, after being developed, and the drag streaks in such materials are conspicuous, and therefore, the present invention can effectively be applied to such materials. Also in the case of the photographic materials both surfaces of which have been coated, the total $\gamma$ value of the both surfaces is preferred to fall within the above-mentioned range.

The drag streaks often become problematic, when the photographic light-sensitive materials have a size larger than a certain size (for example, having a size of 100 mm × 100 mm or more). On the other hand, these hardly become problematic in the case of microfilms, etc., since the size of the photographic light-sensitive materials is small and the processing bath can be thoroughly stirred during the processing of the materials. Accordingly, the present invention is especially effective, when applied to the automatic processing of such large-sized photographic light-sensitive materials with an automatic developing machine.

The photographic light-sensitive materials for use in the present invention can have two or more silver halide emulsion layers, but the amount of silver coated on one side is desirably from 1 $g/m^2$ to 3.5 $g/m^2$ for the rapid processing of the present invention. More preferably, the said silver amount coated on one side is from 1 $g/m^2$ to 3 $g/m^2$.

When the materials of the present invention are black-and-white photographic materials, the mean grain size of the silver halide grains is preferably 1.0 μm or less, especially 0.7 μm or less, as mentioned above.

The silver halide grains in the photographic emulsion for use in the present invention may be so-called regular grains having a regular crystal form such as cubic, octahedral or tetradecahedral grains, or may be irregular grains having an irregular crystal form such as spherical grains or those having a crystal defect such as a twin plane, etc., or tabular grains, or may also be composite grains having a composite form of these crystal forms.

The aspect ratio in tabular grains means the ratio of the mean value of the diameter of the circle having the same area as the projected area of the respective tabular grains to the mean value of the grain thickness of the respective tabular grains. Preferred tabular grains for use in the present invention have an aspect ratio of from 4 to less than 20, more preferably from 5 to less than 10. The grain thickness is preferably 0.3 μ or less, especially preferably 0.2 μ or less.

The proportion of the tabular grains to the total grains in the emulsion is preferably 80% by weight or more, more preferably 90% by weight or more.

Regarding the grain size distribution of the silver halide grains in the emulsion for use in the present invention, the emulsion may be either a monodispersed emulsion having a narrow grain size distribution or a polydispersed emulsion having a broad grain size distribution.

The silver halide photographic emulsions for use in the present invention can be prepared by known methods, for example, by the methods described in *Research Disclosure*, No. 17643 (December, 1978), pages 22-23, "I. Emulsion Preparation and Types", and ibid., No. 18716 (November, 1979), page 648.

Further, the photographic emulsions for use in the present invention can also be prepared by the methods described in P. Glafkides, *Chimie et Physique Photographique* (published by Paul Montel, 1967), G. F. Duffin, *Photographic Emulsion Chemistry* (published by Focal Press, 1966), V. L. Zelikman et al, *Making and Coating Photographic Emulsion* (published by Focal Press, 1964), etc.

During the formation of the silver halide grains for use in the present invention, a silver halide solvent, for example, ammonia, potassium rhodanide, ammonium rhodanide, thioether compounds (such as those described in U.S. Pat. Nos. 3,271,157, 3,574,628, 3,704,130, 4,297,439, 4,276,374, etc.), thione compounds (such as those described in Japanese Patent Application (OPI)-Nos. 144319/78, 82408/78, 77737/80, etc.), amines (such as those described in Japanese Patent Application (OPI) No. 100717/79, etc.), etc. can be used for the purpose of controlling the growth of the grains.

In the practice of the present invention, a water-soluble rhodium salt or a water-soluble iridium salt, for example, can be used.

The incorporation of iridium ion can be attained by addition of a water-soluble iridium compound (for example, hexachloroiridate(III) or hexachloroiridate(IV), etc.) to the silver halide emulsion during the preparation thereof, in the form of an aqueous solution. For the addition of the said aqueous solution, the solution can be added in the form of the same solution of halide(s) for the formation of the grains, and this can be added at any stage of before the grain formation, during the grain formation or between the grain formation and the chemical sensitization. Especially preferably, the solution is added during the grain formation.

In the practice of the present invention, the iridium ion is incorporated into the emulsion preferably in an amount of from $10^{-8}$ to $10^{-5}$ mol, more preferably from $5\times10^{-7}$ to $5\times10^{-6}$ mol, especially preferably from $10^{-7}$ to $10^{-6}$ mol, per mol of the silver halide in the emulsion.

For reaction of a soluble silver salt and soluble halide(s) to obtain the silver halide grains for use in the present invention, a single jet method, a double jet method or a combination thereof can be employed.

A so-called reverse mixing method capable of forming silver halide grains in the presence of excessive silver ions can also be employed. As one system of the double jet method, a so-called controlled double jet method of keeping a constant pAg in a liquid phase of forming silver halide grains can also be employed. According to the method, a silver halide emulsion containing silver halide grains having a regular crystal form and almost uniform grain sizes can be obtained.

The silver halide emulsions for use in the present invention may be chemically sensitized or may not be chemically sensitized.

For the chemical sensitization of the emulsions, a conventional sulfur sensitization, reduction sensitization or noble metal sensitization or a combination thereof can be employed.

Specific examples of chemical sensitizers which can be used in the chemical sensitization include sulfur sensitizers such as allylthiocarbamide, thioureas, thiosulfates, thioethers, cystine, etc.; noble metal sensitizers such as potassium chloroaurate, aurous thiosulfate, potassium chloropaladate, etc.; reducing sensitizers such as tin chloride, phenylhydrazine, reductones, etc.

The silver halide emulsions for use in the present invention are optionally spectrally sensitized with known spectral sensitizers, if desired. Examples of spectral sensitizers which can be used in the present invention are described, for example in *Research Disclosure*, Vol. 176, No. 17643, Item IV (December, 1978).

The above-mentioned sensitizing dyes may be incorporated into the silver halide photographic emulsions for use in the present invention, in an amount of from $5\times10^{-7}$ mol to $5\times10^{-2}$ mol, preferably from $1\times10^{-6}$ mol to $1\times10^{-3}$ mol, especially preferably from $2\times10^{-6}$ mol to $5\times10^{-4}$ mol, per mol of the silver halide in the emulsion.

The sensitizing dyes can be dispersed directly in the emulsion layer. Alternatively, these may be dissolved first in a suitable solvent, such as methyl alcohol, ethyl alcohol, methylcellosolve, acetone, water, pyridine, or a mixed solvent thereof, and the resulting solution can be added to the emulsion. For the dissolution of the dyes, ultrasonic waves can also be used. Specifically, the sensitizing dyes can be added to the emulsions by various known methods, for example, the method described in U.S. Pat. No. 3,469,987 where a dye is dissolved in an organic solvent and the resulting solution is dispersed in a hydrophilic colloid and then the resulting dispersion is added to an emulsion; the method described in Japanese Patent Publication No. 24185/71 where a water-insoluble dye is directly dispersed in a water-soluble solvent without being dissolved and the resulting dispersion is added to an emulsion; the method described in U.S. Pat. No. 3,822,135 where a dye is dissolved in a surfactant and the resulting solution is added to an emulsion; the method described in Japanese Patent Application (OPI) No. 74624/76 where a dye is dissolved in a red-shifting compound and the resulting solution is added to an emulsion; the method described in Japanese Patent Application (OPI) No. 80826/75 where a dye is dissolved in a substantially water-free acid and the resulting solution is added to an emulsion, etc. In addition, the methods described in U.S. Pat. Nos. 2,912,3443, 3,342,605, 2,996,287, 3,429,835, etc. can also be employed. The above-mentioned sensitizing dyes can be uniformly dispersed in the silver halide emulsion, before being coated on a support, and it is a matter of course that the dyes can be dispersed therein at any stage of the preparation of the silver halide emulsion.

The above-mentioned sensitizing dyes can be combined with any other sensitizing dyes, for use in the present invention. For example, the sensitizing dyes described in U.S. Pat. Nos. 3,703,377, 2,688,545, 3,397,060, 3,615,635 and 3,628,964, British Patents 1,242,588 and 1,293,862, Japanese Patent Publication Nos. 4396/68, 14030/69 and 10773/68, U.S. Pat. No. 3,416,917, Japanese Publication No. 4930/68, U.S. Pat. Nos. 2,615,613, 3,615,632, 3,617,295 and 3,635,721, etc. can be used.

For rapid processing of the silver halide photographic materials containing the hydrophilic colloid layers of the present invention, in accordance with the present invention, the materials are preferred to have a swelling percentage of 200% or less, as mentioned above.

However, if the swelling percentage of the material is too low, the speed of development, fixation, rinsing-in-water, etc. is low, and therefore, it is not preferable to lower the swelling percentage too much overstepping the necessary limit.

Accordingly, the preferred range of the swelling percentage is from 30% to 200%, especially preferably from 50% to 150%.

The adjustment of the swelling percentage to 200% or less can easily be attained by anyone skilled in the art, for example, by increasing the amount of the hardener to be added to the photographic light-sensitive material.

The swelling percentage can be obtained by a process comprising (a) the step of incubating the photographic light-sensitive material under the condition of 38° C. and 50% RH for 3 days, (b) the step of measuring only the thickness of the hydrophilic colloid layer, (c) the step of dipping the material in 21° C. distilled water, and (d) the step of comparing the thickness of the hydrophilic colloid layer as measured in the step (b) and that as measured in step (c) to thereby obtain the percentage of the variation of the thickness of the layer.

As the hardener which can be used in the present invention, various organic compounds are known, for example, aldehyde compounds, the active halogen-containing compounds described in U.S. Pat. No. 3,288,775, the reactive ethylenic unsaturated group-containing compounds described in U.S. Pat. No. 3,091,537, as well as halogeno-carboxyaldehydes such as mucochloric acid, etc. In particular, vinylsulfone series hardeners are preferably used. In addition, high polymer hardeners can also preferably be used.

As the high polymer hardeners, polymers having an active vinyl group or a precursor group thereof are preferred, and in particular, the polymers described in Japanese Patent Application (OPI) NO. 142524/81, in which an active vinyl group or a precursor group thereof is bonded to the polymer main chain via a long spacer, are especially preferred. The amount of the hardener to be added to the photographic light-sensitive material so as to attain the above-mentioned swelling percentage depends upon the kind of hardener and the kind of gelatin used in the material.

In the photographic light-sensitive material to be processed by the rapid processing of the present invention, it is preferred to incorporate an organic substance which may be dissolved out during development, in the emulsion layers and/or other hydrophilic colloid layers. When gelatin is used as the substance which may be dissolved out, the kind of gelatin is preferably such that it cannot participate in the cross linking reaction of gelatin by hardener, and for example, acetylated gelatin or phthalated gelatin corresponds to gelatin of this kind, and the gelatin is preferred to have a smaller molecular weight for use in the present invention. On the other hand, as other high polymer substances than gelatin, the polyacrylamides described in U.S. Pat. No. 3,271,158, as well as hydrophilic polymers such as polyvinyl alcohol, polyvinyl pyrrolidone, etc. can also effectively be used. Further, saccharides such as dextran, saccarose, pullulan, etc. are also effective. Above all, polyacrylamide and dextran are preferred, and polyacrylamide is especially preferred. These substances are preferably those having a mean molecular weight of 20,000 or less, more preferably 10,000 or less. In addition, the anti-foggant and stabilizer described in *Research Disclosure,* Vol. 176, NO. 17643, Item VI (December 1978) can also be used.

As the developing agent in the black-and-white developer for use in the development procedure of a present invention, a combination of a dihydroxybenzene and a 1-phenyl-3-pyrazolidone is most preferred, because a favorable capacity can easily be attained. Of course, the developer may further contain a p-aminophenol series developing agent.

The dihdyroxybenzene developing agents for use in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, etc., and hydroquinone is most preferred among them.

The p-aminophenol series developing agents for use in the present invention include N-methyl-p-aminophenol, p-aminophenol, N-(β-hydroxyethyl)-p-aminophenol, N-(4-hydroxyphenyl)glycine, 2-methyl-p-aminophenol, p-benzylaminophenol, etc., and N-methyl-p-aminophenol is most preferred among them.

The 3-pyrazolidone series developing agents for use in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-tolyl-4,4-dimethyl-3-pyrazolidone, 1-p-tolyl-4-methyl-4-hydroxymethyl-3-pyrazolidone, etc.

The developing agent is generally used preferably in an amount of from 0.01 mol/liter to 1.2 mol/liter.

As a sulfite preservative for use in the development procedure of the present invention, there may be mentioned sodium sulfite, potassium sulfite, lithium sulfite, ammonium sulfite, sodium bisulfite, potassium metabisulfite, etc. The amount of the sulfite to be added is preferably 0.2 mol/liter or more, especially preferably 0.4 mol/liter. The upper limit thereof is preferably up to 2.5 mol/liter.

The developer to be used for the development procedure of the present invention is preferred to have a pH value of from 9 to 13, more preferably from 10 to 12.

As an alkali agent to be used for adjustment of the pH value, there is a pH-adjusting agent, such as sodium hydroxide, sodium carbonate, potassium carbonate, sodium tertiary phosphate, potassium tertiary phosphate, etc.

In addition, other buffers such as the borates described in Japanese Patent Application (OPI) No. 186259/87, the compounds described in Japanese Patent Application (OPI) No. 93433/85 (e.g., saccharose, acetoxime, 5-sulfosalicylic acid, etc.) as well as phosphates, carbonates, etc. may also be used.

A dialdehyde series hardener or a bisulfite adduct thereof can be used in the above-mentioned developer, and specific examples thereof include glutaraldehyde or a bisulfite adduct thereof.

As other additives than the above-mentioned components which can be added to the developer, there may be mentioned, for example, a development inhibitor such as sodium bromide, potassium bromide or potassium iodide; an organic solvent such as ethylene glycol, diethylene glycol, triethylene glycol, dimethylformamide, methylcellosolve, hyxylene glycol, ethanol or methanol; antifoggants such as mercapto compounds (e.g., 1-phenyll-5-mercaptogtetrazole, sodium 2-mercaptobenzimidazole-5-sulfonate, etc.), indazole series compounds (e.g., 5-nitroindazole), benzotriazole series compounds (e.g., 5-methylbenzotriazole, etc.), etc. In addition, the development accelerators described in *Research Disclosure,* Vol. 176, No. 17643, Item XXI (December,1978) and optionally toning agents, surfactants, defoaming agents, water softeners, the amino compounds described in Japanese Patent Application (OPI) No. 106244/82, etc. can also be added.

Further, the developer to be used for the development procedure of the present invention can also contain a silver stain-inhibitor, for example, the compound described in Japanese Patent Application (OPI) No. 124347/81.

The developer for use in the present invention can also contain an amino compound such as the alkanolamine described in Japanese Patent Application (OPI) No. 106244/81.

In addition, the compounds described in L.F.A. Mayson, *Photographic Processing Chemistry* (published by Focal Press, 1966), pages 226–229, U.S. Pat. No. 2,193,015 and 2,592,364, Japanese Patent Application (OPI) No. 64933/73, etc. can also be used.

The fixing solution for use in the present invention is an aqueous solution containing a thiosulfate, which has a pH value of 3.8 or more, preferably from 4.2 to 7.0, more preferably from 4.5 to 5.5.

As the fixing agent there can be used sodium thiosulfate, ammonium thiosulfate, etc., and ammonium thiosulfate is most preferred in view of the fixing speed. The amount of the fixing agent to be used can appropriately be varied, but in general, this is from about 0.1 mol/liter.

The fixing solution can contain a water-soluble aluminum salt which acts as a hardener, and examples thereof include aluminum chloride, aluminum sulfate, potassium alum, etc.

The fixing solution can contain tartaric acid, citric acid, gluconic acid or derivatives thereof, singly or in combination of two or more. These compounds are incorporated into the fixing solution effectively in an amount of 0.005 mol or more per liter of the solution, especially effectively from 0.01 mol/liter to 0.03 mol/liter.

The fixing solution can optionally contain a preservative (for example, sulfites, bisulfites), a pH buffer (for example, acetic acid, boric acid), a pH adjusting agent (for example, sulfuric acid), a chelating agent having a water-softening capacity as well as the compound described in Japanese Patent Application (OPI) No. 78551/87.

For the rapid processing in accordance with the present invention, the swelling percentage of the photographic light-sensitive material to be processed is to be small as mentioned above (preferably from 150% to 50%), and the hardening by processing is preferably weak. Specifically, it is preferred that the photographic material is not hardened during development, and it is more preferred that this is also not hardened during fixation, but the fixing solution may be made to have a pH of 4.6 or more so that the material is weakly hardened. In the latter case of weakly hardening the material, there may be a merit in that one replenishing agent can be used for both the developer and the fixing solution and the replenisher can be prepared merely by diluting the agent with water.

In the procedure of developing the silver halide photographic material, according to the present invention, the materials, after being developed and fixed, can be processed with a rinsing water or a stabilizing solution using a replenisher of 3 liter or less per $m^2$ of the material (or using no replenisher for washing with stagnant water).

Accordingly, not only economization of water to be used for the rinsing step is possible but also provision of ducts in the AD machine can be simplified, in accordance with the method of the present invention.

For reducing the amount of the replenisher, a multistage counter-current system (for example, a two-stage or 3-stage system) has been known from the past. The multi-stage counter-current system can efficiently be employed for the practice of the present invention, where the photographic light-sensitive material, after being processed for fixation, may gradually be processed to the direction of a clearer processing solution in the rinsing step, or that is, the material may successively be contacted with a clearer processing (rinsing) solution which is not contaminated by the fixing solution. Accordingly, more efficient rinsing is possible by the multi-stage counter-current system rinsing.

In the above-mentioned economical or piping-free rising process, it is preferred to apply a fungicidal means to the rinsing water or stabilizing solution.

For the fungicidal means, the ultraviolet irradiation method described in Japanese Patent Application (OPI) No. 263939/85; the method of using a magnetic field described in Japanese Patent Application (OPI) NO. 263940/85; the method of using an ion-exchange resin to prepare pure water described in Japanese Patent Application (OPI) No. 131632/86; the method of using fungicides described in Japanese Patent Application (OPI) Nos. 115154/87, 153952/87, 220951/87 and 209532/87, etc. can be employed.

Further, the bactericides, fungicides, surfactants, etc. described in L. E. West, *Photo. Sci. & Eng.*, Vol. 9 NO. 6, (1965), "Water Quality Criteria"; M. W. Beach, *SMPTE Journal*, Vol. 85 (1976), "Microbiological Growths in Motion-Picture Processing"; R. O. Deegan, *J. Imaging Tech.*, Vol. 10, No. 6 (1984), "Photo Processing Wash Water Biocides"; and Japanese Patent Application (OPI) Nos. 8542/82, 58143/82, 105145/83, 132146/82, 18631/83, 97530/82, 157244/82, etc. may also be used.

In addition, the bath for rinsing-in-water or stabilization may also contain the isothiazoline series compounds described in R. T. Kreiman, *J. Image. Tech.*, 10, (6), page 242 (1984), the isothiazoline series compounds described in *Research Disclosure*, Vol. 205, No. 20526 (May, 1981), the isothiazoline series compounds described in ibid., Vol. 228, No. 22845 (April, 1983), the compounds described in Japanese Patent Application (OPI) No. 209532/87, etc., as a microbicide.

Further, the compounds described in H. Horiguchi, *Bactericidal and Fungicidal Chemistry* (by Sankyo Publishing, 1982) and *Handbook for Bactericidal and Fungicidal Technique* (by Japan Bactericidal and Fungicidal Association, Giho-do, 1986) can also be added to the rinsing water or stabilizer.

When the photographic material is rinsed with a small amount of water in the method of the present invention, it is more preferred to provide a squeeze roller washing tank (described in Japanese Patent Application No. 163217/86) in the rinsing bath. Further, the rinsing step constitution described in Japanese Patent Application No. 290619/86 can also be employed preferably in the method of the present invention.

A part or all of the over-flow solution from the rinsing-in-water bath or stabilization bath, which is caused by the replenishment of a fungicidally processed water to the rinsing-in-water bath or stabilization bath in accordance with the photographic procedure of the present invention, can be re circulated back to the fixing solution in the previous processing bath, in the same manner as described described in Japanese Patent Application (OPI) NO. 235133/85.

When the silver halide photographic material of the present invention is processed with an automatic developing machine in accordance with the above-mentioned procedure at least comprising the steps of development, fixation, rinsing-in-water (or stabilization) and drying, the period from the development to the drying is preferably within 70 seconds or less, or that is, a so-called dry-to-dry time of from the point when the top of the photographic material begins to be dipped in the developer to the point when the top of the material, through the fixation and rinsing-in-water (or stabilization) steps, begins to be taken out from the drying zone is preferably within 70 seconds or less. More preferably, the dry-to-dry time is 60 seconds or less.

In the present invention, the "time for development step" or "development time" means, as mentioned above, the period from the point when the top of the photographic light-sensitive material as being processed begins to be dipped in the developer tank solution in the AD machine to the point when the material begins to be dipped in the next stopping bath or the fixation solution; the "fixing time" means the period from the point when the material begins to be dipped in the fixation tank solution to the point when this begins to be dipped in the next rinsing tank solution (or stabilization tank solution); and the "rinsing time" means the period while the material is dipped in the rinsing tank solution.

The "drying time" means the period while the material is in the drying zone which is equipped on the AD machine. Hot air of generally from 35° C. to 100° C., preferably from 40° C. to 80° C., is being blown through the drying zone.

The rapid processing to be finished within the above-mentioned dry-to-dry time of 70 seconds or less can be attained only by the present method where the development is finished within 15 seconds or less. The development temperature in such rapid development in the method of the present invention is preferably from 25° C. to 50° C., more preferably from 30° C. to 40° C.

The fixation temperature and time are preferably from about 20° C. to about 50° C. and from 6 seconds to 20 seconds, respectively, and more preferably, from 30° C. to 40° C. and from 6seconds to 15 seconds, respectively.

The rinsing-in-water or stabilization temperature and time are preferably from 0° C. to 50° C. and from 6 seconds to 20 seconds, respectively, and more preferably, from 15° C. to 40° C. and from 6 seconds to 15 seconds, respectively.

In accordance with the method of the present invention, the photographic light-sensitive material as processed by development, fixation and rinsing-in-water (or stabilization) is, after being squeezed with a squeeze roller to remove the rinsing solution, dried. The drying is carried out at a temperature of from about 35° C. to about 100° C., and the drying time is, although changeable in accordance with the environmental conditions, generally from about 5 seconds to about 30 seconds, more preferably from about 5 seconds to about 20 seconds at a temperature of from 40° C. to t 80° C.

When the photographic light-sensitive material is processed for a shortened period of 70 seconds or less by the dry-to-dry processing system is accordance with the present invention, various means are preferably employed so as to prevent the development unevenes which is specific to the rapid development procedure. For example, rubber rollers are provided in the outlet port of the development tank, as described in Japanese Patent Application No. 297672/86; the jet flow speed in the developer tank for the purpose of stirring the developer in the tank is set to be 10 m/min or more, as described in Japanese Patent Application 297673/86; or a stronger stirring is imparted to the developer at least during the development procedure than during the waiting period, as described in Japanese Patent Application No. 315537/86. For carrying out the rapid processing of the present invention, the constitution of the roller in the fixation tank is, in particular, preferably in the form of a pair of facing rollers so that the fixation speed can be elevated or, in the case of a sensitizing dye-containing photographic material, the dissolution of the dye can be accelerated. By employing facing rollers, the number of rollers can be decreased so that the capacity of the processing tank can be reduced. Accordingly, the AD machine to be used for the method of the present invention can be simplified and can be made compact.

The photographic light-sensitive materials to be processed by the method of the present invention are not specifically limited and the method can be applied to not only any conventional black-and-white photographic materials but also any conventional color photographic materials. In particular, the method of the present invention is especially preferably applied to photographic materials for clinical image laser printers, photographic materials for printing scanners, as well as X-ray photographic materials for clinical direct photography, X-ray photographic materials for clinical indirect photography, photographic materials for CRT image-recording, etc.

The following examples are intended to illustrate the present invention but not to limit it in any way.

Unless otherwise specified, all percents, ratios, etc. are by weight.

EXAMPLE 1

(1) Preparation of Monodispersed Silver Halide Emulsion

Ammonia was placed in a container containing gelatin, potassium bromide and water and warmed at 55° C., and then an aqueous silver nitrate solution and an aqueous potassium bromide solution, to which hexachloroiridate (III) salt had been added in a molar ratio of iridium of $10^{-7}$ mol to silver, were added thereto by a double jet method, to obtain monodispersed silver bromide emulsion grains. By varying the amount of the ammonia added, three kinds of emulsion grains, each having a mean grain size of 0.7 μ, 0.4 μ or 0.25 μ, were prepared. (These were designated as Emulsion (A), Emulsion (B) and Emulsion (C), respectively.) In these emulsions, 98% of the number of the total grains had a size falling within the range of the mean grain size ±40% thereof. In the latter stage of the formation of the grains, potassium iodide was added in an amount of $1\times10^{-3}$ mol per mol of silver. The emulsion was, after being demineralized, adjusted to have a pH of 6.2 and a pAg of 8.6 and then subjected to gold-sulfur sensitization with sodium thiosulfate and chloroauric acid, to obtain the desired photographic property. The ratio of (100)/(111) of the emulsion was measured by Kubelka-Munk method of be 93/7.

(2) Preparation of Emulsion-containing Coating Composition

The above-mentioned three kinds of emulsions were placed in a container singly or in the form of a mixture of the emulsions, in the total amount of 1 kg, and heated at 40° C. to dissolve the emulsion. Next, 70 cc of a methanol solution of the following infrared sensitizing dye ($9\times10^{-4}$ mol/liter), 90 cc of an aqueous solution of the following super color sensitizer ($4.4\times10^{-3}$ mol/liter), 35 cc of a methanol solution of the following storability-improving agent ($2.8\times10^{-2}$ mol/liter), an aqueous 4-hydroxy-6-methyl-1,3,3*a*,7-tetraazaindene solution, polyacrylamide (molecular weight, 45,000), an aqueous solution of a coating aid of dodecylbenzenesulfonic acid solution and an aqueous solution of a tackifier of polypotassium-p-vinylbenzenesulfonate compound were added to the said emulsion, to obtain an emulsion-containing coating composition.

Infrared Sensitizing Dye:

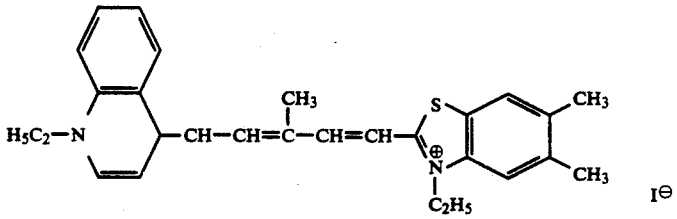

Supersensitizer

Disodium 4,4'-bis[2,6-di(naphthyl-2-oxy)pyrimidin-4-ylamino]stylbene-2,2'-disulfonate.

Storability-improving Agent:

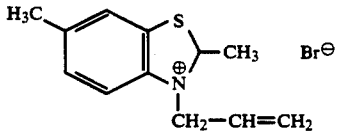

(3) Preparation of Coating Composition for Surface Protective Layer for Protecting Photographic Layer To an aqueous 10 wt. % gelatin solution at 40° C. were added polyacrylamide (molecular weight, about 45,000), an aqueous solution of a thickening agent of sodium polystyrenesulfonate, fine polymethyl methacrylate grains (mean grain size 3.0 μ) as a matt agent, N,N'-ethylenebis-(vinylsulfonylacetamide) as a hardening agent, an aqueous solution of a coating aid of sodium t-octylphenoxyethoxyethane-sulfonate and an aqueous polystyrene series surfactant solution and an aqueous solution of the fluorine compounds having the following structural formulae as an antistatic agent, to form a coating composition.

$C_8F_{17}SO_2N(C_3H_7)CH_2COOK$ and $C_8F_{17}SO_2N(C_3H_7)(CH_2CH_2O)_{15}H$

(4) Preparation of Coating Composition for Backing Layer

To 1 kg of an aqueous 10 wt. % gelatin solution at 40° C. were added an aqueous solution of a thickening agent of sodium polystyrenesulfonate, 50 cc of an aqueous solution of the backing dye ($5\times10^{-2}$ mol/liter), an aqueous solution of a hardening agent of N,N'-ethylenebis(vinylsulfonylacetamide) and an aqueous solution of a coating aid of sodium t-octylphenoxyethoxyethane-sulfonate, to prepare a coating composition.

(5) Preparation of Coating Composition of Surface Protective Layer for Protecting Backing Layer To an aqueous 10 wt. % gelatin solution at 40° C. were added an aqueous solution of a tackifier of sodium polyethylenesulfonate, fine polymethyl methacrylate grains (mean grain size 3.0 μ) as a matt agent, an aqueous solution of a coating aid of sodium t-octylphenoxyethoxyethane-sulfonate and, as an anti-static agent, an aqueous polyethylene series surfactant and an aqueous solution of the fluorine compounds having the following structural formulae, to prepare a coating composition.

$C_9F_{17}SO_2N(C_3H_7)CH_2COOK$ and
$C_8F_{17}SO_2N(C_3H_7)(CH_2CH_2O)_{15}H$ (6) Formation of Coated Samples The above-mentioned backing layer-coating composition and the above-mentioned backing layer-protecting layer-coating composition were laminated on one surface of a polyethylene terephthalate support in a gelatin amount of 3 g/m$^2$. Subsequently, the near infrared sensitizing dye-containing coating solution prepared in step (3) above and the surface protective layer-coating composition were applied on the other side of the support such that the amount of silver coated is as shown in Table 1 below and the total amount of gelatin coated was 3.5 g/m$^2$ including 1.5 g/m$^2$ of gelatin in the surface protective layer, and the amount of the hardening agent in the surface protective layer film was adjusted so that the swelling percentage of the layer film, which was defined as mentioned below, could be 110%. After being thus coated, various kinds of photographic film samples were prepared.

(7) Measurement of Swelling Percentage

The swelling percentage was obtained by a process comprising (a) the step of incubating the photographic sample under the conditions of 38° C. and 50 % RH, (b) the step of measuring the thickness of the layer, (c) the step of dipping the sample in 21° C. distilled water for 3 minutes, and (d) the step of comparing the thickness of the layer measured in step (b) and that measured after step (c) to thereby obtain the percentage of the variation of the thickness of the layer.

(8) Conventional Sensitometry

The samples prepared in step (6) above were stored under the conditions of 25° C. and 65% RH for 7 days, and then the samples were subjected to scanning exposure with a semiconductor laser having a wavelength of 780 nm for 10-7 second. After the exposure, the samples were developed in the automatic developing machine shown in the Figure, in accordance with the processing steps described below.

The developer and the fixing solution had the following compositions each in the form of a concentrated solution.

| | |
|---|---|
| Concentrated Developer Solution: | |
| Potassium Hydroxide | 60 g |
| Sodium Sulfite | 100 g |
| Potassium Sulfite | 125 g |
| Diethylenetriamine-pentaacetic Acid | 6 g |
| Boric Acid | 25 g |
| Hydroquinone | 87.5 g |
| Diethylene Glycol | 28 g |
| 4-Hydroxymethyl-4-methyl-1-phenyl-3-pyrazolidone | 4.2 g |
| 5-Methylbenzotriazole | 0.15 g |
| Water to make | 1 liter |
| (pH was adjusted to 11.0) | |
| Concentrated Fixing Solution: | |
| Ammonium Thiosulfate | 560 g |
| Sodium Sulfite | 60 g |
| Ethylenediamine-tetraacetic Acid Disodium Salt Dithydrate | 0.10 g |
| Sodium Hydroxide | 24 g |
| Water to make | 1 liter |
| (pH was adjusted to 5.10 with acetic acid.) | |

The size of the replenisher kit was 5 liters.

The water stock tank solution container ethylenediamine-tetraacetic acid disodium salt dihydrate (as fungicide) in an amount of 0.5 g/liter.

The samples were processed with the automatic developing machine (see FIG. 1) by a dry-to-dry 60 second system as follows:

| | | |
|---|---|---|
| Development Tank (1) | 7.5 liters | 35° C. × 11.5 sec (facing rollers) |
| Fixation Tank (2) | 7.5 liters | 35° C. × 12.5 sec (facing rollers) |
| Rinsing Tank (3) | 6 liters | 20° C. × 7.5 sec (facing rollers) |
| Squeeze Roller Washing Tank (7) | 200 ml | |
| Water Stock Tank (4) | 25 liters | |
| Drying | | |

In the above process, although heaters were used so as to control the temperature of the development tank and the fixation tank, any cooling water was not used.

Before starting the development, the following processing solutions were placed in the respective tanks.

Development Tank (1)

400 of the above-mentioned concentrated developer solution, 600 ml of water and 10 ml of an aqueous solution containing 2 g of potassium bromide and 1.8 g of acetic acid. The pH was 10.50.

Fixation Tank (2)

250 ml of the above-mentioned concentrated fixing solution and 750 ml of water.

Rinsing Tank (3) and Washing Tank (7)

The same solution as the above-mentioned stock solution was placed in the both tanks.

The photographic samples (B4 size, 25.7 cm×36.4 cm) were processed in accordance with the processing system of FIG. 1, whereupon (a) 30 ml of the stock tank solution and 20 ml of the concentrated developer solution were replenished to the developer tank, (b) 10 ml of the concentrated fixing solution and 30 ml of a part of the over-flow solution from the rinsing tank were replenished to the fixation tank, and (c) 60 ml of the stock tank solution was replenished to the rinsing tank (in the direction opposite to the film-running direction) form the squeeze roller. 50 sheets/day of B4-size sample film (development percentage of one film sheet: 40%) were continuously processed by a running procedure, whereupon fresh replenishers were replenished to the developers, fixing solution and water, if necessary.

In the development procedure, the flow speed of the circulating and stirring amount of the developer was set to be 20 liters/min while the photographic samples were actually developed in the development tank, and the speed was set to be 6 liters/min during the waiting period while the samples were not actually being developed.

After the one-day development operation was finished, the rollers in the crossovers of the development tank-fixation tank and the fixation tank-rinsing tank were by intermittently and automatically showering 80 m,l of water in the above-mentioned rinsing water stock tank upon the rollers from 10 small holes, in accordance with the method described in Japanese Patent Application No. 131338/86.

One group of the photographic samples was processed by the dry-to-dry system for a period of the total processing time of 60 seconds (the invention), while the other group of the photographic samples was processed by the dry-to-dry system for a longer period of processing time of 96 seconds (comparison). The processing time of the latter comparison was 1.6 times of that of the invention. All other conditions were the same in both groups, and the development temperature and the fixation temperature were both 33° C. The results obtained are shown in Table 1 below.

TABLE 1

| Film No. | Emulsion and Mixture Ratio | Silver Coated (g/m2) | Development System | Development Procedure as Defined by the Invention(*1) (Developed Density after Half Development Time) | Drag Streaks by AD machine(*2) | G(*3) |
|---|---|---|---|---|---|---|
| 1 (Comparison) | A only | 3.8 | Dry-to-dry 96 sec. (Development 18.4 sec. inclusive) | 60% | Not Present | 2.98 |
| | | | Dry-to-dry 60 sec. (Development 11.5 sec. inclusive) | 49% | Noticeably Present | 2.92 |
| 2 (Invention) | A + B (1/1) | 3.3 | Dry-to-dry 60 sec. (Development 11.5 sec. inclusive) | 71% | Almost Not Present | 2.70 |
| 3 (Invention) | A + B + C (1/1/1) | 2.85 | Dry-to-dry 60 sec. (Development 11.5 sec. inclusive) | 76% | Absolutely Not Present | 2.16 |

(*1)The method of obtaining the data for the development procedure was as follows: the same solutions as filed in the development tank, fixation tank and rinsing tank before the start of the development procedure were placed in a 2-liter tank, individually. Strips (35 mm × 12 cm) of the respective samples exposed in the same manner as above were developed in these processing tanks once for one second while the strips were moved up and down in the tank at the same processing temperature. The data obtained by the development are shown in Table 1. The photographic characteristics of the samples processed by the solutions corresponding to those of the samples processed with equilibrated solutions (after being used in the running procedure in the AD machine) by the same tank development system.

(*2)The evaluation of the drag streaks was performed as follows: In the above-mentioned running experiment, the film samples exposed with an SMPTE pattern so that the maximum density (Dmax) after the development was 2.64 and the background density was 50% were used for evaluation, in accordance with SMPTE recommended practice RP 13-1986 (Specification for Medical Diagnostic Imaging Test Pattern for Television Monitors and Hard Copy Recording Cameras).

(*3)Measurement of G was as follows: the G value between the point of (fog density + 0.8) and the point of (fog density + 2.0) was measure.

The results of Table 1 demonstrate that the film sample Nos. 2 and 3 of the present invention formed sharp images with no drag streaks, although these were processed by an extremely rapid processing procedure.

EXAMPLE 2

(1) Preparation of Emulsion 30 g of gelatin and 6 g of potassium bromide were added to one liter of water and kept at 60° C. in a container, and an aqueous silver nitrate solution (containing 5 g of silver nitrate) and an aqueous potassium bromide solution containing 0.15 g of potassium iodide were added thereto with stirring by a double jet method over one minutes. Further, an aqueous silver nitrate solution (containing 145 g of silver nitrate) and an aqueous potassium bromide solution containing 4.2 g of potassium iodide were added also by double jet method, whereupon the flow speed for addition was so accelerated that the flow speed at the finish of the addition was to be 5 times that at the beginning of the addition. After the completion of the addition, the soluble salts were removed by a flocculation method at 35° C., and then the temperature was elevated to 40° C. and 75 g of gelatin was added. Then, the pH was adjusted to 6.7. The thus obtained emulsion contained tabular grains having a projected area diameter of 0.98 μm and a mean thickness of 0.138 μm, in which the silver iodide content was 3 mol %. The emulsion was chemically sensitized by gold-sulfur sensitization.

(2) Preparation of Photographic Material

For formation of the surface protective layer, an aqueous gelatin solution containing, in addition to gelatin, polyacrylamide having a mean molecular weight of 8,000, sodium polystyrenesulfonate, fine polymethyl methacrylate grains (mean grain size 3.0 μm), polyethylene oxide and a hardening agent, etc. was used.

To the resulting emulsion was added anhydro-5,5=-dichloro-9-ethyl-3-3'-di(3-sulfopropyl)oxacarbocyanine-hydroxide sodium salt, as a sensitizing dye, in a proportion of 500 mg/mol-Ag. Also, potassium iodide was added thereto in a proportion of 200 mg/mol-Ag. Further, 4-hydroxy-6-methyl-1,3,3a-7-tetrazaindene and 2,6-bis(hydroxyamino)-4-diethyl-amino-1,3,5-triazine, as a stabilizer, and nitron, trimethylol propane as a drying fog-inhibitor, as well as a coating aid and a hardening agent were added to obtain a coating composition. This was coated on both surfaces of a polyethylene terephthalate support, together with the surface protective layer on both surfaces, and dried to give a photographic material sample. The silver amount coated on one surface of the sample was 2 g/m$^2$, and the swelling percentage, the definition of which was given hereinabove, was 120%.

The thus prepared photographic material sample was exposed with X-rays and developed in the same manner as in the process of Example 1 except that the amount of 4-hydroxymethyl-4-methyl-1-phenyl-3-pyrazolidone used was two times of the amount used in the process of Example 1. As a result, no drag streaks appeared in the developed sample.

On the basis of the examples described hereinsabove, the effect of the present invention can be summarized as follows: According to the method of the present invention, the uneven development (drag streaks) can effectively be overcome, which has heretofore been inevitable when a silver halide photographic material is processed by rapid processing with an automatic developing machine for a shortened developement period of time of 15 seconds or less.

While the invention has been described in detail and with reference to specific embodiments thereof, it will be apparent to one skilled in the art that various changes and modifications can be made therein without departing from the spirit and scope thereof.

What is claimed is:

1. A method of preventing drag streaks which occur in rapid development of 11.5 to 15 seconds by development of a silver halide photographic material with an automatic developing machine such that the dry-to-dry time is 32 to 70 seconds, wherein said silver halide photographic material comprises a combination of (1), (2) and (3) where (1) represents a silver halide emulsion containing a water-soluble iridium salt such that the amount of iridium ion is from $10^{-8}$ to $10^{-5}$ mol per mol of the silver halide in the emulsion;

(2) represents a silver halide emulsion layer with a silver amount from 1 to 3.5 grams/$m^2$ coated on one surface of said emulsion layer; and (3) represents silver halide grains wherein the mean grain size is 0.25 $\mu$to 1.0 $\mu$;

wherein 11.5 to 15 seconds is set as the development time and when the silver halide photographic material is exposed and developed for a period of one-half of said development time, the exposed silver halide photographic material gives a value of (D−fog) which is 70% or more of the value of $(D_{max}-\text{fog})\times\frac{1}{2}$ obtained by development for said development time.

2. The method of preventing drag streaks as in claim 1, wherein the silver halide photographic material comprises a silver halide with an iodine content of no more than 5 mol %.

3. The method of preventing drag streaks as in claim 2, wherein the silver halide photographic material comprises silver chloride, silver bromide, silver chlorobromide, silver iodobromide or silver chloroiodobromide having an iodine content of no more than 5 mol %.

4. The method of preventing drag streaks as in claim 1, wherein the silver halide photographic material has a swelling percentage of 200% or less.

* * * * *